US005347976A

United States Patent [19]

Saunders

[11] Patent Number: 5,347,976

[45] Date of Patent: Sep. 20, 1994

[54] PEEP SIGHT WITH FIELD-VIEWING FRAME

[75] Inventor: Charles A. Saunders, Columbus, Nebr.

[73] Assignee: Saunders Archery Company, Columbus, Nebr.

[21] Appl. No.: 5,110

[22] Filed: Jan. 15, 1993

[51] Int. Cl.[5] ..... F41B 5/00

[52] U.S. Cl. ..... 124/87; 124/90; 33/265

[58] Field of Search ..... 124/87, 86, 90, 24.1, 124/23.1, 1; 33/265

[56] References Cited

U.S. PATENT DOCUMENTS

| | | | |
|---|---|---|---|
| 3,703,771 | 11/1972 | Saunders | 124/90 X |
| 3,859,733 | 1/1975 | Chesnick | 33/265 |
| 4,011,853 | 3/1977 | Fletcher | 124/87 |
| 4,833,786 | 5/1989 | Shores, Sr. | 33/265 |
| 4,895,129 | 1/1990 | Hedgpeth | 124/90 X |
| 4,934,332 | 6/1990 | Scherz | 124/87 |
| 5,148,603 | 9/1992 | Beutler | 33/265 |

*Primary Examiner*—Eric K. Nicholson
*Assistant Examiner*—Harry C. Kim
*Attorney, Agent, or Firm*—Michael G. Berkman

[57] ABSTRACT

A bowstring-mounted peep sight providing, in combination, a relatively large open sight window for ensuring good vision over a substantial field to be surveyed, and a small, centered, peep hole for enhanced target accuracy, A hub-like ring defining the small diameter peep hole is supported by ribs or vanes radiating toward fixedly to engage a larger circumscribing field-viewing frame.

Desired multiple capabilities, including both better overall field identification and viewing, and sharper target sighting, are made feasible in a single, dual-function mechanical structure. Staggered string slots in side channel guide walls allow one to effect stabilized fixed and locked positions of the sighting device on the bowstring without resort to serving.

2 Claims, 1 Drawing Sheet

PEEP SIGHT WITH FIELD-VIEWING FRAME

FIELD AND BACKGROUND OF THE INVENTION

The present invention relates to a peep sight for archery use to facilitate sighting and for improving precision and accuracy. More particularly, the invention is directed to a bowstring-mounted peep sight which provides, in combination, an expansive field-framing window and a restricted target-sighting peep opening.

Peep sights used in archery are well-established aiming devices contributing to enhancement of the skills of the archer. Peep sights of the general class of the device of the invention are mounted on the bowstring above the nocking point so that upon drawing the bowstring back the archer may align the small bore of the peep sight with a bow sight pin or with a target. The locating of a target and the sighting on a target through a constricted, small-diameter peep sight is a difficult task aggrevated by the very limited field that is viewable through the peep sight. The target once "lost", it is difficult to relocate and to reorient the peep sight bore in registry with the intended precise field of interest. Also, even the slightest misalignment of the bore of the peep sight with a line of sight of the archer tends to render it impossible to view through the peep sight bore to sight the target.

One prior bowstring-mounted peep sight includes a relatively large viewing area or window in which a light-impervious, much smaller aiming plate or "dot" is centered. Viewing through the "dot" is inherently impossible. Nor is such viewing intended. The structure described has not found acceptance among archery enthusiasts. Others of the prior art bowstring-mounted peep sights have their own shortcomings or objectionable features. It is, therefore, a principal aim of the present invention to provide a combination sighting device for archery use which renders it possible to retain a general view of a relatively broad field or general target area while at the same time sighting a specific and limited target zone through a relatively small-diameter-bore peep sight. The archer is enabled to keep the target in his field of view so that any need to "relocate" the target is obviated.

SUMMARY OF THE INVENTION

The bowstring mounted peep sight of the present invention provides, simultaneously, dual sighting windows or viewing fields, in a unitary and integrally-molded mechanical device. One element is a bowstring-carried frame which delineates a relatively broad field of view. As a second component, a peep sight having a small through bore is supported within the viewing frame for precision target sighting therethrough for enhanced targeting accuracy.

It is an important feature of the invention that the general field of targeting interest is viewable through a large open frame while, at the same time, the particular, specific target or selected target zone can be sighted through a small-diameter-bore peep sight. The unique structure described effectively prevents the target from passing out of the archer's field of view and line of sight.

The sighting device of the invention is formed with outwardly-opening grooves or channels at opposed lateral walls of the frame for receiving divided strands of a multi-strand bowstring therethrough. Tension forces secure the sight fixed in position on the bowstring.

A related feature of the sight of the invention is the provision of pairs of staggered slots formed in the channel walls and through which the strands of the bowstring are trained and retained under tension, thereby firmly locking the device in selectable positions on the bowstring and negating any need for serving.

It is yet another feature of the invention that the small-bore-peep sight is supported within the frame by a plurality of thin ribs, spokes or vanes so that 80% or more of the frame-bordered viewing area is left unimpaired.

Another feature of the-invention is that the peep sight bore is tapered or flared outwardly to enhance target sighting therethrough.

Other and further features and advantages of the invention will be evident upon a reading the following detailed description, considered in conjunction with the drawings.

DETAILED DESCRIPTION OF ILLUSTRATED EMBODIMENTS

Figure 1:
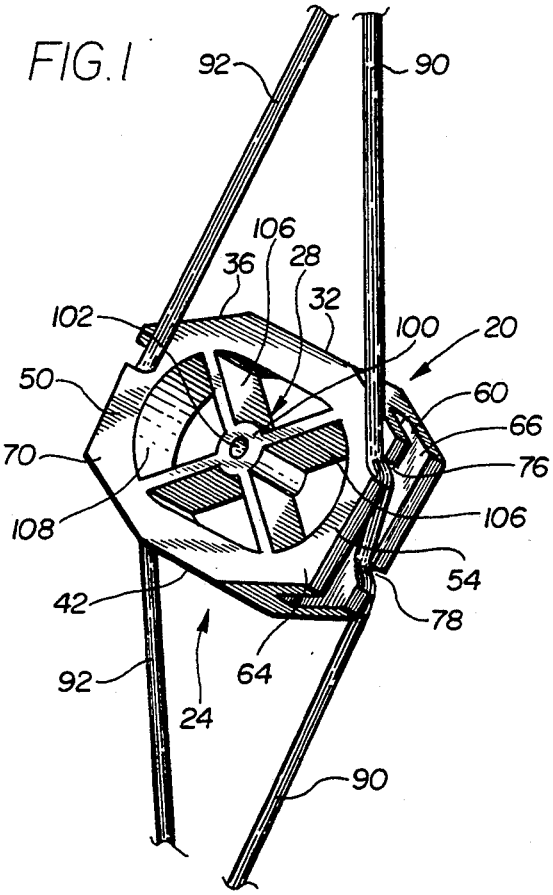
FIG. 1 is a perspective view, with parts cut away, of a bowstring mounted peep sight with field-viewing frame, in accordance with the invention and embodying the features thereof.

In accordance with the present invention, the aims and objects are achieved by providing a device which includes, in a unitary bowstring-mounted structure, a substantially open frame for viewing the target field, and a frame-carried peep sight having a restricted bore through which the precise, selected target area or zone may be sighted. Using the device of the present invention, the archer is enabled to retain in sight, simultaneously, the broader or general viewing field as well as a selected, definitive, limited target zone.

The device is attached to the bow by dividing the strands of a multi-stranded bowstring and training the separated sets of strands through grooves or side channels formed in the bounding walls of the frame. In a preferred embodiment of the invention the channel-defining, laterally-spaced walls are formed with staggered cut-outs or slots. The divided strands of the bowstring are woven through the slots in a tensioned mode to hold the device fixed in selectable positions. Thus, any need for serving or other auxiliary structures is obviated.

Referring now more particularly to the drawing, for purposes of disclosure and not in any limiting sense, a preferred embodiment of the combination field-view and target-area-sighting device of the invention is shown as a unitary assembly 20 defining an outer field-viewing frame 24 in which a centrally-positioned peep sight 28 is supported. In the particular embodiment of the device illustrated, the frame 24 is bilaterally symmetrical about each of vertical and horizontal bisecting planes. A three-faceted top wall 30 includes a center section 32 joined at each end to downwardly pitched walls 36 and 38. A bottom wall 40 consists of opposed components including a center section 42 joined at each end to upwardly angled wall segments 46 and 48. Parallelly-disposed, opposed side walls 50 and 54 connect, respectively, top walls 36 and 46 and 38 and 48 (FIG. 4).

Figure 2:
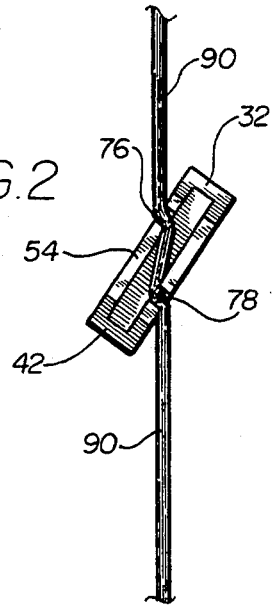
FIG. 2 is a side elevational view of the dual viewing field peep sight mounted on a bowstring.
Figure 3:
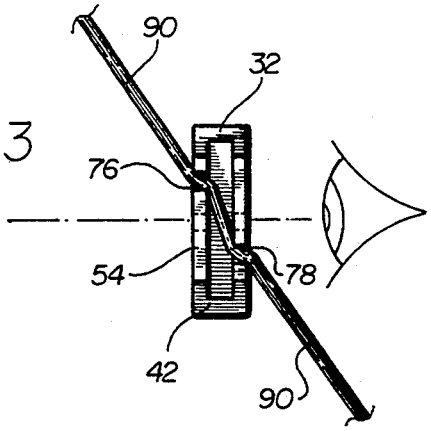
FIG. 3 is a side elevational view of the peep sight of FIG. 2, but with the bowstring in a drawn configuration.

As shown in FIG. 1, the side walls 50 and 54 are formed with vertical grooves or channels 60 which divide the side walls 50 and 54 into spaced, parallel front and rear wall elements, 64, 66 and 70, 72. The forwardly and rearwardly spaced wall elements 64, 66 and 70, 72 are formed with laterally opening staggered slots 76 and 78, in wall elements 54 and 66, and staggered slots 82 and 84 in wall elements 50 and 72. The multi-stranded bowstring is divided so that one group of strands 90 is positionable to seat in slots 76 and 78 while the other strands 92 are trained through the opposite pair of staggered slots 82 and 84 (FIG. 1). The distortion produced in the tensioned bowstring strands establishes frictional forces which maintain the sighting assembly 20 fixed in any selected position. FIG. 2 indicates, schematically, the composite sighting assembly 20 secured to an undrawn bowstring, while the disposition of the assembly 20 when the bowstring is drawn, is shown in FIG. 3, the axial bore of the peep sight being aligned functionally to correlate with a sighting path of the archer.

Figure 4:
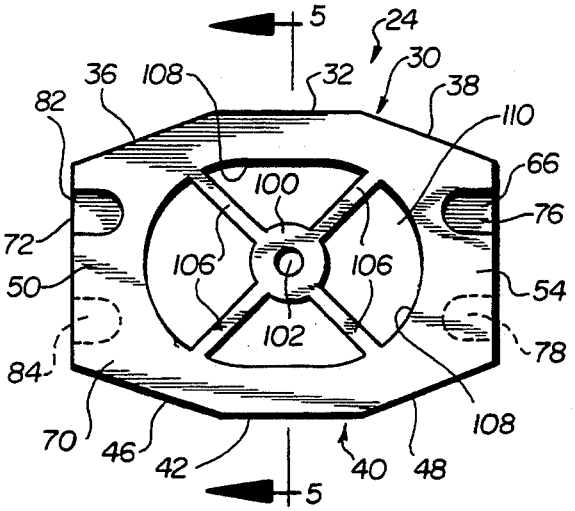
FIG. 4 is a front elevational view of a peep sight, according to the present invention.
Figure 5:
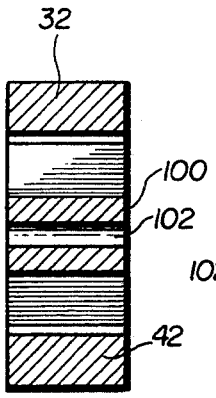
FIG. 5 is a cross-sectional view taken substantially on the lines 5—5 of FIG. 4 and delineating the two fields of view, the view having been enlarged for clarity.
Figure 6:
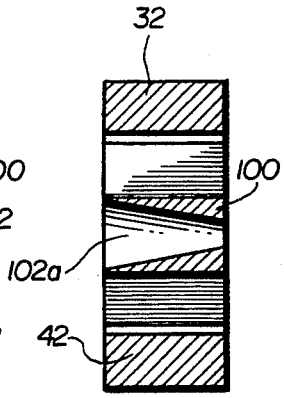
FIG. 6 is a view similar to FIG. 5 but showing an embodiment of the peep sight in which the peep bore is flared outwardly to enhance sighting therethrough.

Referring now further to FIGS. 1 and 4, the peep sight 28 is shown as a hub 100 formed with a small through axial bore, "peep", or sighting orifice 102 (FIG. 5). In one preferred embodiment of the invention the sighting orifice 102*a* is tapered or flared outwardly to enhance the sighting operation (FIG. 6). As shown in FIGS. 1 and 4, the hub 100 of the peep sight 28 is supported within the frame 24 by radially extending spoke-like ribs or vanes 106 which connect the hub 100 to the inside wall 108 of the frame 24. The peep sight orifice 102 is centered within the larger framed opening 110 embraced by the inner wall 108 of the frame 24.

What is claimed is:

1. A dual-field sighting device for archery use, said device comprising frame means having bounding walls defining open window means for viewing broadly therethrough a sighting field delineated thereby, a peep sight having a restricted, through sighting aperture, and vane means attached to and extending inwardly of said walls of said frame means for supporting said peep sight, said peep sight being centered in said window means for target sighting through said restricted, through, sighting aperture formed in said peep sight, guide means integrally formed with said frame means at lateral walls thereof for receiving divided strands of a bowstring therewithin for attaching said device to the bowstring, said guide means including spaced parallel flanges extending normally of and outwardly of each of a pair of opposed side walls of said frame means to define an open-ended passage within forward and rearward planar bounds of said frame means, said passage constituting channel means for receiving bowstring strands trained and restricted therewithin, staggered string slots being formed in said spaced parallel flanges and extending transversely through said flanges for receiving strands of the bowstring therethrough in a distorted configuration and in frictionally gripping, tensioned, and stressing engagement with bounding walls of said slots in in said flanges to obviate any need to employ other mechanical means for securing said sighting device in selectable positions along the bowstring.

2. The device as set forth in claim 1 wherein said peep sight comprises a hub with said sighting aperture extending axially therethrough, and wherein said vane means comprise spoke-like ribs attached to and extending radially between said hub and said frame means for supporting said hub centered within said frame means.

* * * * *